US007867002B1

(12) United States Patent
Lin et al.

(10) Patent No.: US 7,867,002 B1
(45) Date of Patent: Jan. 11, 2011

(54) WIRE CONNECTOR

(75) Inventors: Chang-Yi Lin, Chang-Hwa (TW); Chao-Ping Yeh, Chang Hwa (TW)

(73) Assignee: K.S. Terminals Inc., Chang Hwa (TW)

( * ) Notice: Subject to any disclaimer, the term of this patent is extended or adjusted under 35 U.S.C. 154(b) by 0 days.

(21) Appl. No.: 12/761,640

(22) Filed: Apr. 16, 2010

(51) Int. Cl.
*H01R 25/00* (2006.01)

(52) U.S. Cl. ..... 439/292; 439/271

(58) Field of Classification Search ..... 439/271, 439/275, 290, 292, 372
See application file for complete search history.

(56) References Cited

U.S. PATENT DOCUMENTS 4,702,538 A * 10/1987 Hutter et al. ..... 439/292
4,859,201 A * 8/1989 Marsh ..... 439/290
5,035,649 A * 7/1991 Collier et al. ..... 439/607.41
5,174,777 A * 12/1992 Carter ..... 439/290

* cited by examiner

*Primary Examiner*—Khiem Nguyen
(74) *Attorney, Agent, or Firm*—Reed Smith LLP

(57) ABSTRACT

A wire connector includes first and second connecting members that are adapted to hold respectively at least one wire to be connected separably to each other, a waterproof ring, and a locking unit. The waterproof ring is sleeved on a first connecting segment of the first connecting member. The second connecting member includes a second connecting segment sleeved releasably on the first connecting segment, and a receiving segment surrounding the waterproof ring for watertight contact with the waterproof ring. The locking unit includes two engaging components disposed on the second connecting member, and two hook components disposed on the first connecting member and engaging respectively and detachably the engaging components for pulling the receiving segment toward a shoulder of the first connecting segment to cooperate with the shoulder to clamp tightly the waterproof ring therebetween, thereby securing firmly the second connecting member to the first connecting member.

7 Claims, 5 Drawing Sheets

WIRE CONNECTOR

BACKGROUND OF THE INVENTION

1. Field of the Invention

The invention relates to a connector, more particularly to a wire connector.

2. Description of the Related Art

As shown in FIG. 1, U.S. Design Pat. No. D494,933 S discloses a conventional connector 100 including first and second connecting members 11, 12. Each of the first and second connecting members 11, 12 is disposed for holding two wires (not shown). By coupling the first connecting member 11 to the second connecting member 12, the wires held by the first connecting member 11 can be connected respectively to the wires held by the second connecting member 12.

However, since the abovementioned engagement between the first and second connecting members 11, 12 is not a waterproof engagement, moisture may permeate into the conventional wire connector through a gap between the first and second connecting members 11, 12 after long term use to result in rusting of contact ends of the wires, thereby resulting in a relatively short service life of the conventional wire connector.

SUMMARY OF THE INVENTION

Therefore, the object of the present invention is to provide a wire connector that can overcome the above drawbacks associated with the prior art.

Accordingly, a wire connector of the present invention is adapted for connecting a plurality of wires, and comprises a hollow first connecting member, a resilient waterproof ring, a hollow second connecting member, and a locking unit. The first connecting member is adapted to hold at least one of the wires, surrounds an axis, and includes a first connecting segment and a first extending segment. The first connecting segment has an outer surrounding surface, and has an abutment portion formed at one end of the first connecting segment and having a shoulder that protrudes outwardly from the outer surrounding surface. The first extending segment is connected to said end of the first connecting segment and extends in an axial direction away from said end of the first connecting segment. The waterproof ring is sleeved on the abutment portion of the first connecting segment. The second connecting member is adapted to hold at least another one of the wires to be connected separably to the at least one of the wires held by the first connecting member, surrounds the axis, and includes a second connecting segment, a receiving segment and a second extending segment. The second connecting segment is sleeved releasably on the first connecting segment of the first connecting member. The receiving segment extends in the axial direction from one end of the second connecting segment toward the abutment portion of the first connecting segment of the first connecting member, surrounds the waterproof ring, and has an inner surface for watertight contact with the waterproof ring. The second extending segment extends in the axial direction from the other end of the second connecting segment away from the receiving segment. The locking unit includes a pair of engaging components that are disposed on opposite lateral sides of one of the first and second connecting members, and a pair of hook components that are disposed on opposite lateral sides of the other one of the first and second connecting members, and that engage respectively and detachably the engaging components for pulling the receiving segment toward the shoulder to cooperate with the shoulder to clamp tightly the waterproof ring therebetween, thereby securing firmly the second connecting member to the first connecting member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
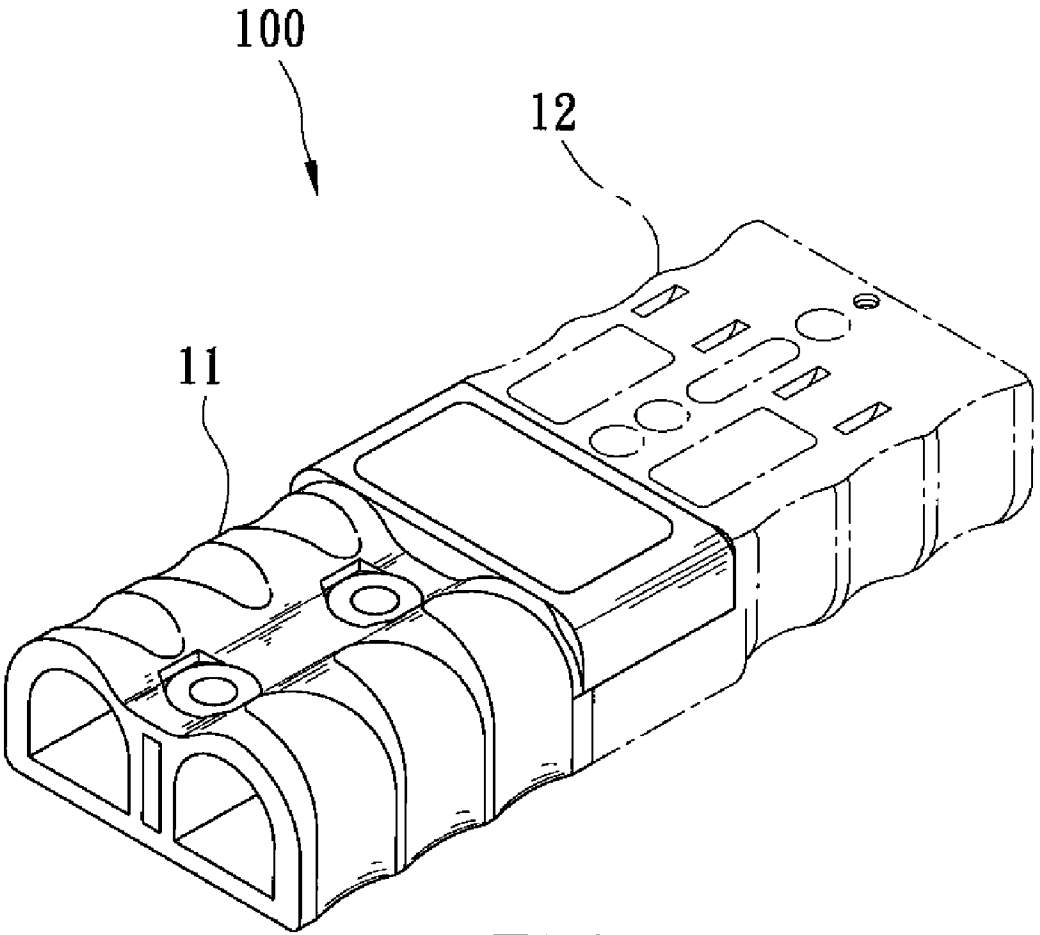
FIG. 1 PRIOR ART
FIG. 1 is a perspective view of a conventional wire connector.
Figure 2:
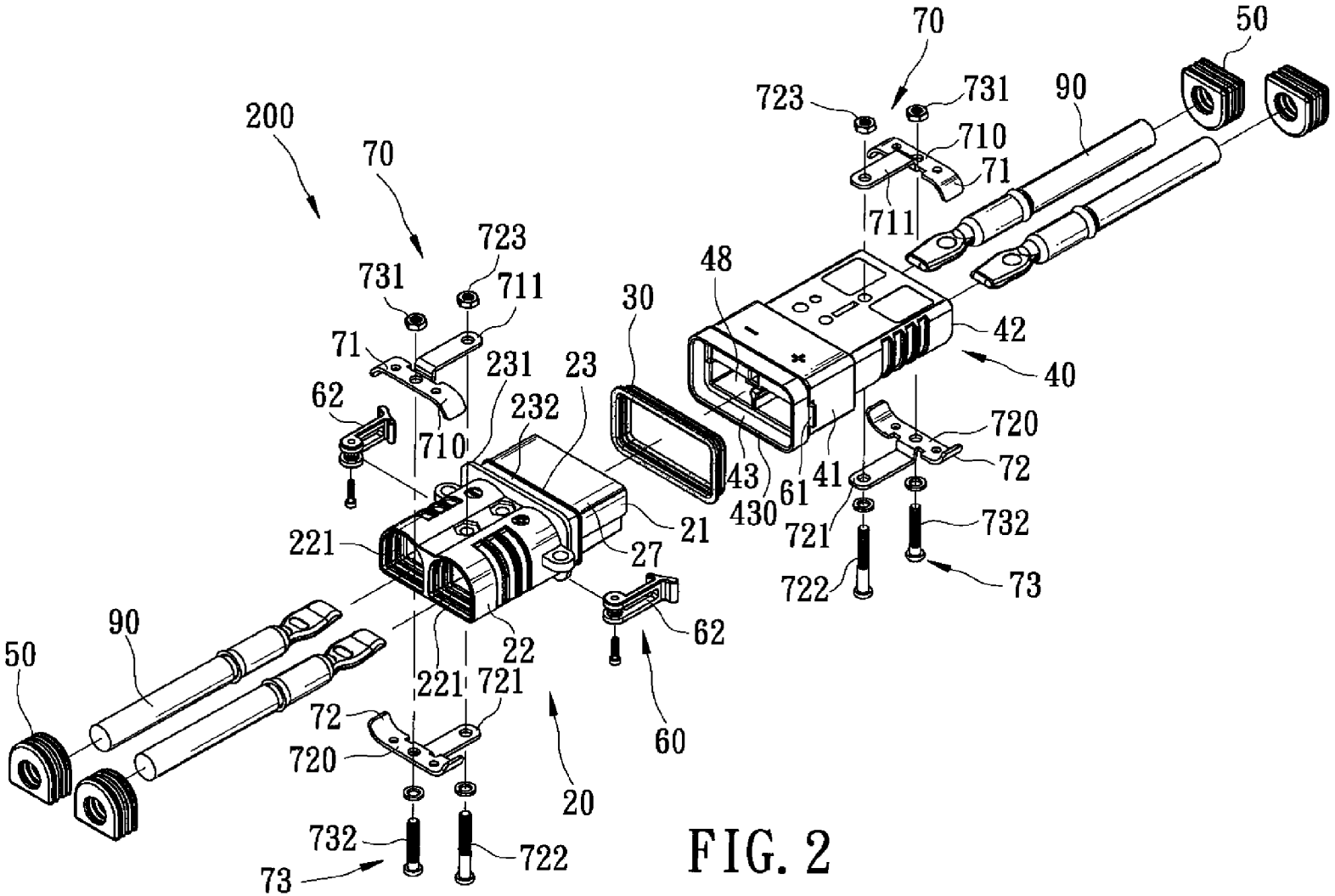
FIG. 2 is an exploded perspective view of a preferred embodiment of a wire connector according to the invention.
Figure 3:
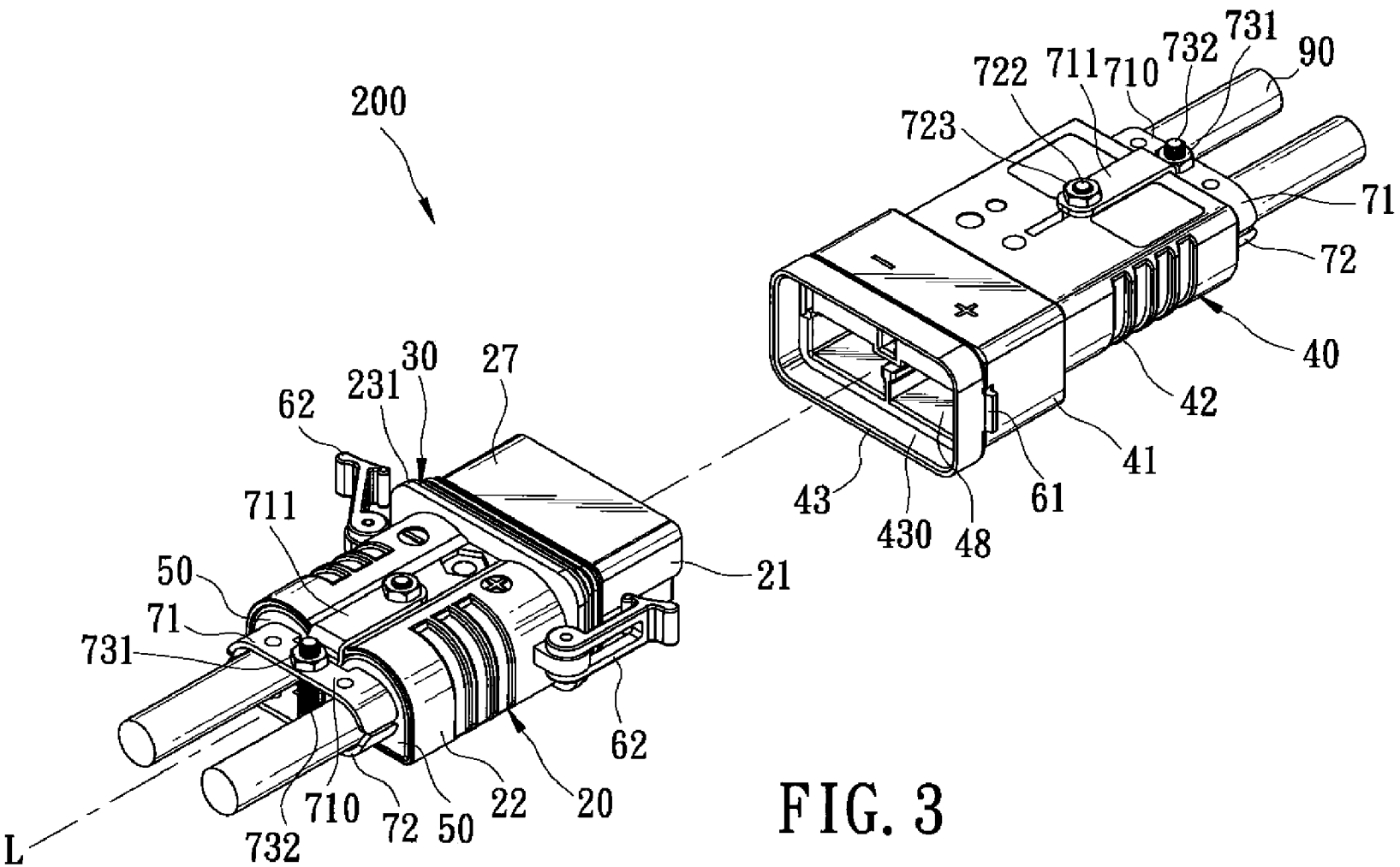
FIG. 3 is perspective view of the preferred embodiment illustrating a first connecting member that is separated from a second connecting member.
Figure 4:
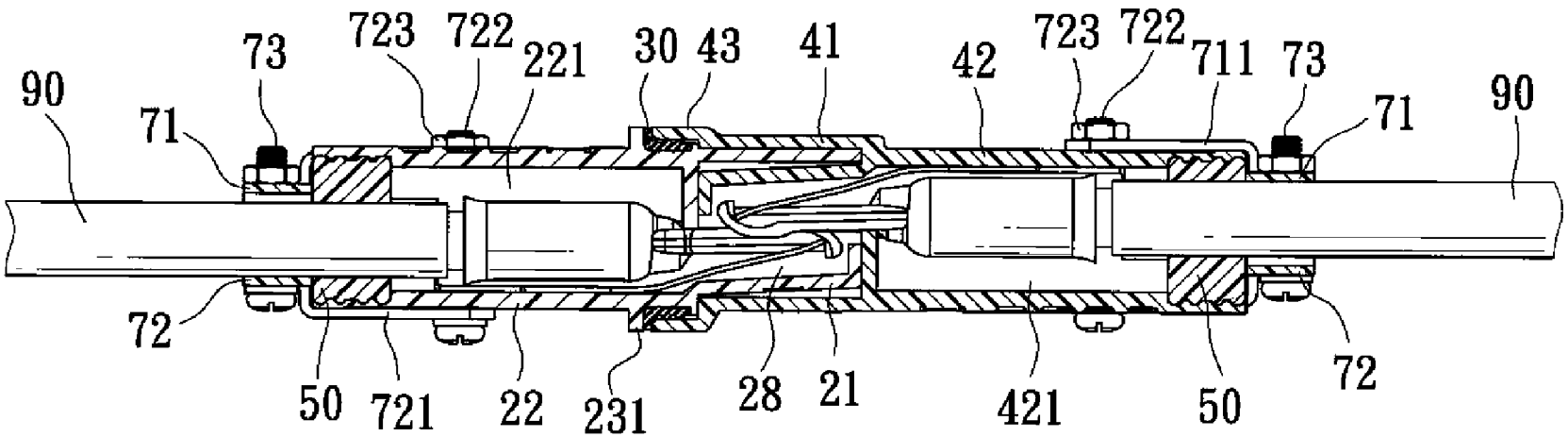
FIG. 4 is a sectional view of the preferred embodiment, illustrating the first connecting member that is coupled to the second connecting member.

As shown in FIGS. 2 to 4, the preferred embodiment of a wire connector 200 according to the present invention is adapted for connecting a plurality of wires 90, and comprises a hollow first connecting member 20, a resilient waterproof ring 30, a hollow second connecting member 40, a plurality of waterproof plugs 50, a locking unit 60, and a pair of securing units 70.

In this embodiment, the first connecting member 20 is adapted for holding a pair of wires 90, surrounds an axis (L) (see FIG. 3), and includes a first connecting segment 21 and a first extending segment 22.

The first connecting segment 21 has a hollow main body that is formed with an outer surrounding surface 27 surrounding the axis (L) and defining an inner chamber 28 (see FIG. 4) therein, an abutment portion 23 that is formed at one end of the first connecting segment 21 and that has a shoulder 231 that protrudes outwardly from the outer surrounding surface 27, and a retaining groove 232 that is formed in the outer surrounding surface 27 adjacent to the shoulder 231.

The first extending segment 22 is connected to said end of the first connecting segment 21, and extends in an axial direction away from said end of the first connecting segment 21. The first extending segment 22 is formed with a pair of first wire-receiving holes 221 that are in spatial communication with the inner chamber 28 of the first connecting segment 21, and that are adapted for extension of contact ends of the wires 90 held by the first connecting member 20 therethrough into the inner chamber 28.

The waterproof ring 30 is sleeved on the abutment portion 23 of the first connecting segment 21 of the first connecting member 20, is retained in the retaining groove 232, and abuts against the shoulder 231.

In this embodiment, the second connecting member 40 is adapted to hold a pair of wires 90 that are to be connected separably to the wires 90 held by the first connecting member 20, and includes a second connecting segment 41, a receiving segment 43, and a second extending segment 42.

The second connecting segment 41 that has a hollow main body defining an inner chamber 48 therein, and is sleeved releasably on the first connecting segment 21 of the first connecting member 20.

The receiving segment 43 extends in the axial direction from one end of the second connecting segment 41 toward the abutment portion 23 of the first connecting segment 21 of the first connecting member 20, surrounds the axis (L), and has an inner surface 430 for watertight contact with the waterproof ring 30.

The second extending segment 42 extends in the axial direction from the other end of the second connecting segment 41 away from the receiving segment 43. The second extends segment 42 is formed with a pair of second wire-receiving holes 421 that are in spatial communication with the inner chamber 48 of the second connecting segment 41, and that are adapted for extension of contact ends of the wires 90 held by the second connecting member 40 therethrough into the inner chamber 48, whereby electrical connection is established between the contact ends of the wires 90 held by the first connecting member 20 and the contact ends of the wires 90 held by the second connecting member 40 when the second connecting segment 41 is sleeved on the first connecting segment 21.

The waterproof plugs 50 are inserted fittingly and respectively into the first and second wire-receiving holes 221, 421. Each of the waterproof plugs 50 is formed with a through hole through which a corresponding one of the wires 90 extends fittingly.

Figure 5:
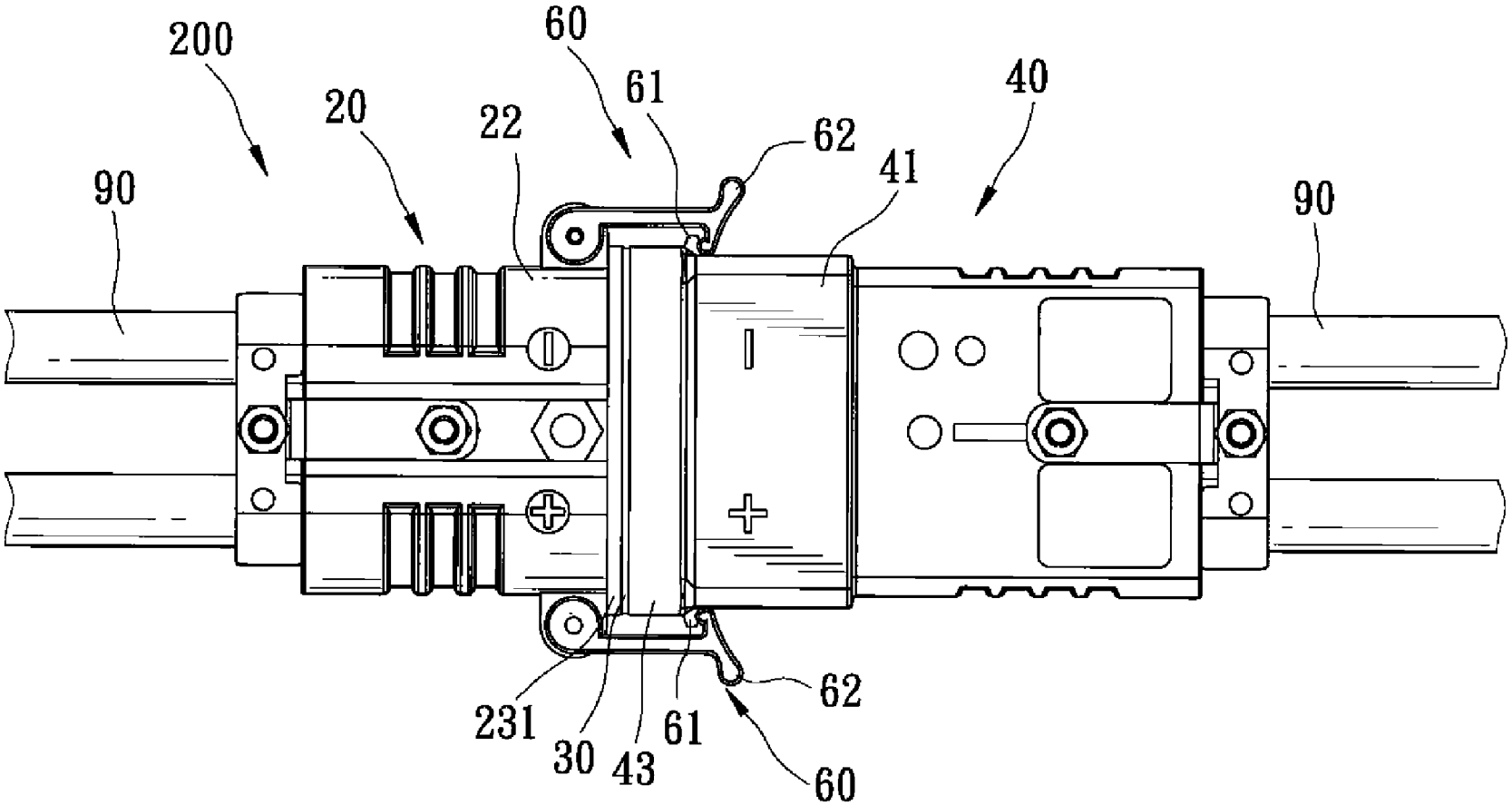
FIG. 5 is a top view of the preferred embodiment, illustrating the first connecting member that is coupled to the second connecting member.

As further shown in FIG. 5, in this embodiment, the locking unit 60 includes a pair of engaging components 61 that are that are disposed on opposite lateral sides of the receiving segment 43 of the second connecting member 40, and a pair of hook components 62 that are disposed on opposite lateral sides of the first extending segment 22 of the first connecting member 20 and that engage respectively and detachably the engaging components 61 for securing firmly the second connecting member 40 to the first connecting member 20. Each of the hook components 62 has an end that is connected pivotally to the first extending segment 22, and an opposite end that engages detachably a corresponding one of the engaging components 61.

The securing units 70 are connected respectively to the first and second extending segments 22, 42 of the first and second connecting members 20, 40. Each of the securing units 70 includes a top clamp 71, a bottom clamp 72, a bolt 722, a nut 723, and a coupling unit 73 interconnecting the top and bottom clamps 71, 72.

The top clamp 71 of each securing unit 70 includes a top blocking portion 710 disposed at one side of the respective one of the first and second extending segments 22, 42 that is axially opposite to the corresponding one of the first and second connecting segments 21, 41 and adapted to abut against top sides of a corresponding pair of the wires 90, and a top securing portion 711 extending from the top blocking portion 710 in a direction parallel to the axis (L), and secured to a top surface of a respective one of the first and second extending segments 22, 42.

The bottom clamp 72 of each securing unit 70 includes a bottom blocking portion 720 disposed at the one side of the respective one of the first and second extending segments 22, 42 that is axially opposite to the corresponding one of the first and second connecting segments 21, 41 and adapted to abut against bottom sides of the corresponding pair of the wires 90, and a bottom securing portion 721 extending from the bottom blocking portion 720 in a direction parallel to the axis (L), and secured to a bottom surface of a respective one of the first and second extending segments 22, 42.

The bolt 722 of each securing unit 70 extends through the top securing portion 711 of the top clamp 71 of the corresponding securing unit 70, the respective one of the first and second extending segments 22, 42 and the bottom securing portion 721 of the bottom clamp 72 of the corresponding securing unit 70. The nut 723 of each securing unit 70 engages threadedly the bolt 722 of the corresponding securing unit 70 so as to secure the top and bottom clamps 71, 72 of the corresponding securing unit 70 to the respective one of the first and second connecting members 20, 40.

The coupling unit 73 of each securing unit 70 includes a bolt 732 extending through the top and bottom blocking portions 710, 720 of the top and bottom clamps 71, 72 of the corresponding securing unit 70, and a nut 731 engaging threadedly the bolt 732 so as to urge the top and bottom blocking portions 710, 720 to clamp the corresponding pair of the wires 90 therebetween, thereby ensuring the corresponding pair of the wires 90 to be connected securely to the corresponding one of the first and second connecting members 20, 40. Moreover, the top and bottom blocking portions 710, 720 cooperate with each other to block a corresponding pair of the first and second wire-receiving holes 221, 421, thereby preventing the waterproof plugs 50 from falling out of the first and second wire-receiving holes 221, 421.

The engagement between the hook components 62 and the engaging components 61 pulls the receiving segment 43 of the second connecting member 40 toward the shoulder 231, such that the waterproof ring 30 is squeezed and deformed by the receiving segment 43 and the shoulder 231 so as to be clamped tightly between the receiving segment 43 and the shoulder 231, thereby rendering the engagement between the first and second connecting members 20, 40 to be a waterproof engagement. Furthermore, the waterproof plugs 50 also effectively prevent moisture from permeating into the wire connector 200 of the invention through the first and second wire-receiving holes 221, 421.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A wire connector adapted for connecting a plurality of wires, said wire connector comprising:

a hollow first connecting member adapted to hold at least one of the wires, surrounding an axis, and including a first connecting segment that has an outer surrounding surface, and an abutment portion formed at one end of said first connecting segment and having a shoulder that protrudes outwardly from said outer surrounding surface, and a first extending segment that is connected to said end of said first connecting segment and that extends in an axial direction away from said end of said first connecting segment;

a resilient waterproof ring sleeved on said abutment portion of said first connecting segment;

a hollow second connecting member adapted to hold at least another one of the wires to be connected separably to the at least one of the wires held by said first connecting member, surrounding the axis, and including a second connecting segment that is sleeved releasably on said first connecting segment of said first connecting member, a receiving segment that extends in the axial direction from one end of said second connecting segment toward said abutment portion of said first connecting segment of said first connecting member, that surrounds said waterproof ring, and that has an inner surface for watertight contact with said waterproof ring, and a second extending segment that extends in the axial direction from the other end of said second connecting segment away from said receiving segment; and a locking unit including a pair of engaging components that are disposed on opposite lateral sides of one of said first and second connecting members, and a pair of hook components that are disposed on opposite lateral sides of the other one of said first and second connecting members, and that engage respectively and detachably said engaging components for pulling said receiving segment toward said shoulder to cooperate with said shoulder to clamp tightly said waterproof ring therebetween, thereby securing firmly said second connecting member to said first connecting member.

2. The wire connector as claimed in claim 1, wherein said abutment portion of said first connecting segment of said first connecting member further has a retaining groove formed adjacent to said shoulder, said waterproof ring being retained in said retaining groove and abutting against said shoulder.

3. The wire connector as claimed in claim 1, wherein:

said engaging components of said locking unit are disposed on the opposite lateral sides of one of said second connecting segment and said receiving segment of said second connecting member; and said hook components of said locking unit are disposed on the opposite lateral sides of said first extending segment of said first connecting member, each of said hook components having an end that is connected pivotally to said first extending segment, and an opposite end that engages detachably a corresponding one of said engaging components.

4. The wire connector as claimed in claim 1, wherein:

said first connecting segment of said first connecting member has a hollow main body formed with said outer surrounding surface and defining an inner chamber therein, said first extending segment of said first connecting member being formed with a pair of first wire-receiving holes that are in spatial communication with said inner chamber of said first connecting segment, and that are adapted for extension of contact ends of two of the wires therethrough into said inner chamber of said first connecting member;

said second connecting segment of said second connecting member has a hollow main body defining an inner chamber therein, said second extending segment of said second connecting member being formed with a pair of second wire-receiving holes that are in spatial communication with said inner chamber of said second connecting segment, and that are adapted for extension of contact ends of two other ones of the wires therethrough into said inner chamber of said second connecting member, whereby electrical connection is established between the contact ends of the two of the wires and the contact ends of the two other ones of the wires when said second connecting segment is sleeved on said first connecting segment.

5. The wire connector as claimed in claim 4, further comprising a plurality of waterproof plugs inserted fittingly and respectively into said first and second wire-receiving holes, each of said waterproof plugs being formed with a through hole through which a corresponding one of the wires extends fittingly.

6. The wire connector as claimed in claim 4, further comprising a pair of securing units that are connected respectively to said first and second extending segments of said first and second connecting members, each of said securing units including a top clamp that is adapted to abut against top sides of a corresponding pair of the wires and that has a top securing portion secured to a top surface of a respective one of said first and second extending segments, a bottom clamp that is adapted to abut against bottom sides of the corresponding pair of the wires and that has a bottom securing portion secured to a bottom surface of the respective one of said first and second extending segments, and a coupling unit that interconnects said top and bottom clamps.

7. The wire connector as claimed in claim 6, wherein said coupling unit of each of said securing units includes a bolt extending through said top and bottom clamps of the corresponding one of said securing units, and a nut engaging threadedly said bolt so as to urge said top and bottom clamps of the corresponding one of said securing units to clamp the corresponding pair of the wires therebetween.

* * * * *